United States Patent [19]

De brey

[11] 3,989,311

[45] Nov. 2, 1976

[54] PARTICLE MONITORING APPARATUS

[76] Inventor: Robert J. De brey, 4502 Browndale Ave., Edina, Minn. 55424

[22] Filed: June 30, 1972

[21] Appl. No.: 268,020

Related U.S. Application Data

[63] Continuation-in-part of Ser. No. 37,157, May 14, 1970, Pat. No. 3,674,316.

[52] U.S. Cl. ..... 302/65; 15/339

[51] Int. Cl.[2] ..... B65G 53/66

[58] Field of Search ..... 302/65; 15/339; 73/194 B

[56] References Cited

UNITED STATES PATENTS

| | | | |
|---|---|---|---|
| 1,633,598 | 6/1927 | McClatchie | 15/339 X |
| 2,936,619 | 5/1960 | Gibney | 73/194 B |
| 3,068,694 | 12/1962 | Worswick | 73/194 B |

FOREIGN PATENTS OR APPLICATIONS

| | | | |
|---|---|---|---|
| 1,184,073 | 3/1970 | United Kingdom | 302/65 |

*Primary Examiner*—Evon C. Blunk
*Assistant Examiner*—Jeffrey V. Nase
*Attorney, Agent, or Firm*—Burd, Braddock & Bartz

[57] ABSTRACT

A particle monitoring apparatus having a particle sensing unit which receives mechanical signals caused by impaction of particles on a sensor and transforms the mechanical signals to an electrical signal related to the amount of particles moving with a fluid, as air. The output signal is used to produce readable information related to the movement of particles in the fluid.

17 Claims, 11 Drawing Figures

PARTICLE MONITORING APPARATUS

CROSS REFERENCE TO RELATED APPLICATION

This application is a continuation-in-part of U.S. application Ser. No. 37,157, filed May 14, 1970, now U.S. Pat. No. 3,674,316. U.S. application Ser. No. 252,323 filed May 10, 1972 is related to U.S. Pat. No. 3,674,316.

BACKGROUND OF THE INVENTION

The measurement of the mass or amount of particles, as dust, powders, dirt, smoke, fine liquids and solid aerosol particles, moving with a fluid, as air, can be accomplished with devices using visual, audio, or electrical parameters. The detection of particles moving in a passage has been accomplished with the use of structure as a probe or screen extended in the passage. These structures interfere with the flow of fluid and material in the passage and also can cause blockage of the passage. Examples of interfering structures in passages are shown by Worswick in U.S. Pat. No. 3,068,696 and Gosbell in British Pat. No. 1,184,073.

Electro-mechanical sensitive material has been used to detect pressure waves resulting from kinetic energy inside the wall of a pipe. Gibney shows in U.S. Pat. No. 2,936,619 a pipe having a plurality of serrations and a transducer which senses the frequencies of the liquid flowing in the pipe over a series of serrations.

SUMMARY OF THE INVENTION

The invention relates to an active monitoring or sensing apparatus operable to provide readable information that is in a direct and reliable relationship to the amount of particles, as dirt, dust, powders, smoke, fine liquids and aerosol particles, moving with a fluid. The particle sensing apparatus has a particle sensing means which includes a first means upon which particles impinge or hit as they flow with a fluid to produce mechanical signals. The first means is located in the flow path in a position so that it does not obstruct the flow of fluid or particles. A second means cooperates with the first means to pick up the mechanical signals and transform the mechanical signals to electrical signals. An output means receives the electrical signals and produces readable information related to the impaction of particles on the first means. This information is in direct relationship to the amount of particles moving with the fluid.

IN THE DRAWINGS

Figure 1:
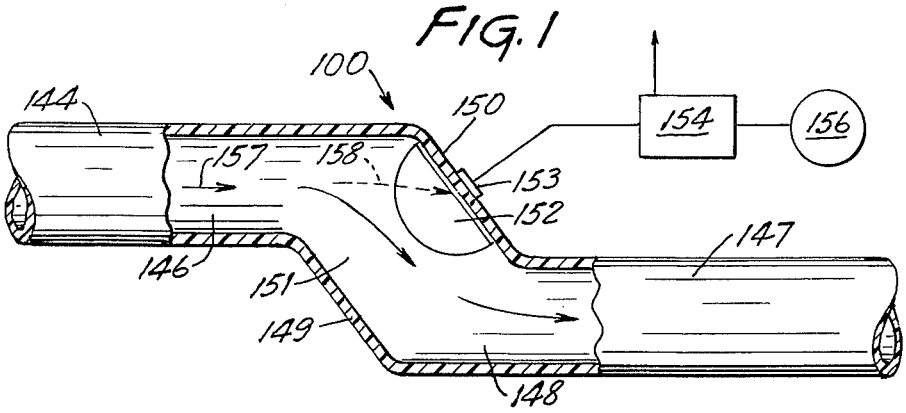
FIG. 1 is a diagrammatic view partly sectioned of the particle monitoring apparatus of the invention.

Referring to FIG. 1, there is shown a particle monitoring apparatus, indicated generally at 100, for sensing particles in a moving fluid. Apparatus 100 has an inlet tube 144 having a first passage 146. Located in an offset relation with respect to tube 144 is a second outlet tube 147 having an exit passage 148. A connecting assembly or housing 149 joins adjacent ends of the tubes 144 and 147. The tubes 144 and 147, as well as the connecting assembly, can be made from a single tube having an offset portion. The connecting assembly 149 has an upper back wall 150 in longitudinal alignment with the first passage 146 and an expansion 151 connecting the passages 146 and 148. Chamber 151 has a cross sectional area larger than the cross sectional area of passages 146 and 148. Located on the back wall 150, within chamber 151, is a particle sensor unit 152 capable of detecting impaction signals of particles which may strike the sensor. The sensor unit 152 includes a piezoelectric crystal attached to the wall 150 with a mount or an attaching member 153. Member 153 may be resilient material. An electronic circuit 154 is connected to the crystal to sense and amplify signals established by the impaction of particles on the crystal. The circuit 154 may have means to drive the crystal at its natural frequency. This frequency is changed as particles strike the crystal. The change in crystal frequency is detected by the output device 156 which is operative to provide a readable signal in proportion to the amount of particles that hit the crystal. The output device 156 may be a visual device, as a light, rate meter, digital counter, an audio device, as a speaker, or other sound producing mechanisms or a mechanical device which provides pulsating or vibrating signals. The circuit 154 can include a microphone operable to amplify and transmit the sound of the particles that hit the sensor.

In use, the fluid and the particles carried by the fluid are drawn through the passage 146, as indicated by arrow 157, toward the sensor 152. The air flow changes direction in the chamber 151 toward the exit passage 148. The particles, indicated by broken arrow 158, having momentum, continue in a forward direction and strike the crystal surface. The sensor unit 152 will continuously monitor the particles flowing in the air stream. The electronic circuit 154 provides an output signal which is proportional to the particles sensed. The signal is transmitted to the output device 156 where it is read by the operator.

Figure 2:
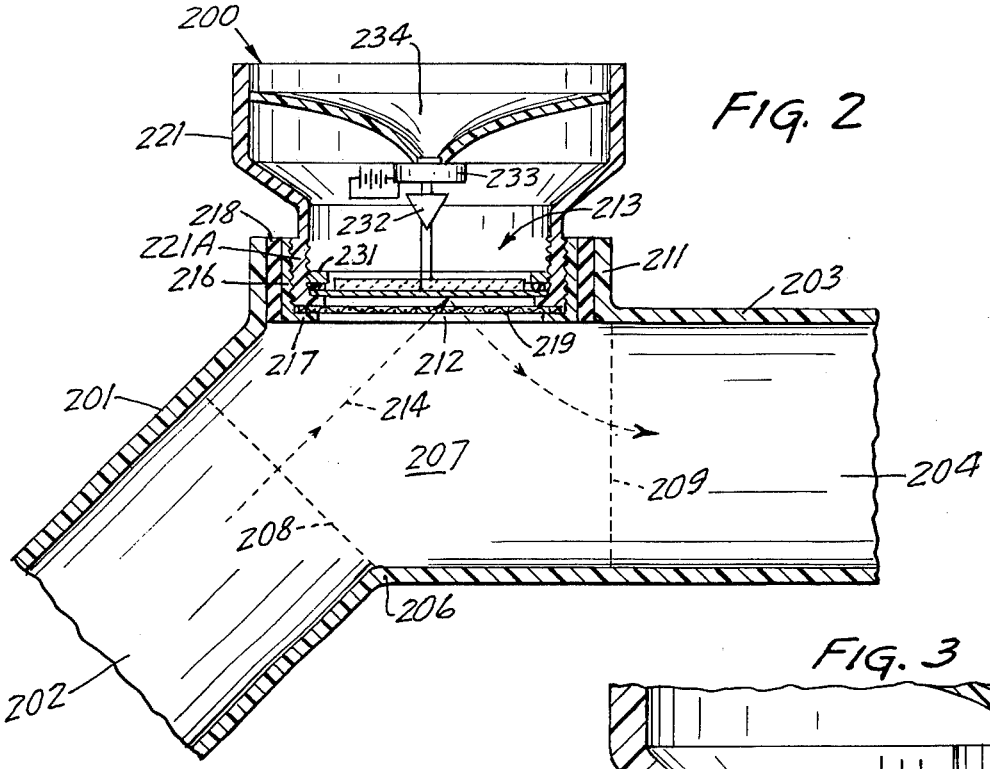
FIG. 2 is a longitudinal sectional view of a first modification of the particle monitoring apparatus of the invention.
Figure 3:
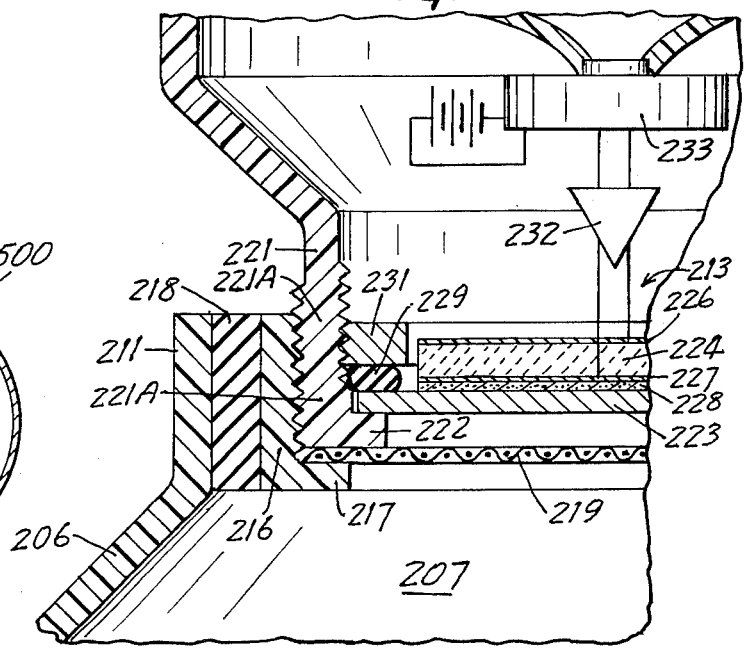
FIG. 3 is an enlarged sectional view of a portion of the sensor of the apparatus of FIG. 2.

Referring to FIGS. 2 and 3, there is shown a modified particle flow monitoring apparatus, indicated generally at 200, for sensing particles entrained in a moving fluid, as air. Device 200 has an inlet tube 201 surrounding a first or inlet passage 202. Angularly disposed with respect to the inlet tube 201 is an outlet tube 203 having a second or exit passage 204. Connecting structure or housing 206 surrounding a chamber 207 joins the inlet tube 201 to the outlet tube 203 to form a one piece angularly shaped housing. Passage 202 is in communication with chamber 207 by means of an inlet opening 208, indicated by a broken line. In a similar manner, the chamber 207 is in communication with the exit passage 204 with an exit opening 209, indicated by a broken line whereby fluid and particles flow through chamber 207.

The top part of the connecting structure 206 has a generally upright annular flange 211 surrounding an opening 212 facing the chamber 207. Opening 212 is aligned with the longitudinal axis of inlet passage 202. Located across opening 212 is a particle sensor unit, indicated generally at 213, capable of detecting mechanical impaction signals of particles, indicated by arrow 214, that may strike the sensing portion of the unit 213, pick up the mechanical signals and transform the mechanical signals to electrical signals. The electrical signals trigger an output means to produce readable information related to the flow and concentration of particles through the monitoring apparatus.

An annular support ring 216 is located within the flange 211. Ring 216 has an inwardly directed shoulder or flange 217. An annular resilient mount 218, as a rubber sleeve, connects the support ring 216 to the inside face of the annular flange 211 to insulate the flange and the sensor unit 213 supported thereby from shock and vibrations that may be imparted to the inlet and outlet tubes or parts connected thereto. Suitable bonding material can be used to secure the resilient mount 218 to flange 211 and to support ring 216.

An open barrier 219, as a mesh screen, extends across opening 212 and is supported on the shoulder 217. The open barrier is a protective member for intercepting large particles so that they do not damage the sensitive portion of the sensor unit. Barrier 219 can be omitted.

Sensing unit 213 has a housing 221 secured to support ring 216. As shown in FIG. 3, the lower portion 221A of the housing 221 has threads which cooperate with complementary threads on the inside face of support ring 216 to attach the housing to the support ring. The housing 221 clamps screen 219 onto shoulder 217. The lower end of housing 221 has an inwardly directed annular lip 222 providing a support surface or shoulder for a rigid impact plate 223. The plate 223 is a first means upon which particles impinge and produce a mechanical signal. Preferably, plate 223 is a metal member, such as stainless steel. Mounted on the upper side of plate 223 is a particle impact sensor 224. The sensor 224 is a piezoelectric ceramic carrying electrode films 226 and 227 on the opposite sides thereof. An electrically conductive bonding material 228, as an adhesive, secures the film 227 to the top of the impact plate 223. The ceramic is a second means operable to pick up the mechanical signal and transform the mechanical signal to an electrical signal.

As shown in FIG. 3, impact plate 223 has an outer peripheral edge that rests on the lip 222. An O-ring 229 engages the top of the outer peripheral edge of plate 223. A retaining ring 231 threaded into housing 221 forces O-ring 229 into engagement with the outer peripheral edge of plate 223, thereby clamping the plate 223 to the lip 222.

Electrode films 226 and 227 are connected with suitable conductor leads to an amplifier 232 which in turn is electrically connected to a circuit 233 containing filters and a speaker or similar signal output means. The output from circuit 233 may be visual, as a light meter, digital counter or audio, as a speaker or other sound producing mechanism. The housing 221 has an inwardly directed recess 234 on the outer side thereof to direct and focus the audio output signal emanating from circuit 233. The piezoelectric ceramic 224 has mechanical to electrical sensing characteristics. The mechanical forces due to impaction of particles on the impact plate 223 cause strain to the electrical film 227 and thereby impart stresses to the ceramic 224. These stresses result in or trigger an electrical output from the ceramic that is amplified by amplifier 232 and transformed into output readable information. The ceramic 224 can be a lead zirconate/titanate material that has a low dielectric constant and a fairly high coupling coefficient. For example, a Honeywell C16 ceramic manufactured by Honeywell, Minneapolis, Minnesota, is a suitable material. Other types of electromechanically sensitive material can be used in lieu of ceramic 224. Circuit 233 may have means to drive the crystal 224 by applying AC power to electrodes 226 and 227. Particles that hit the plate 223 will change the frequency of the crystal. This change in frequency is used to produce an output signal related to the amount of particles that hit the plate 223.

Figure 3A:
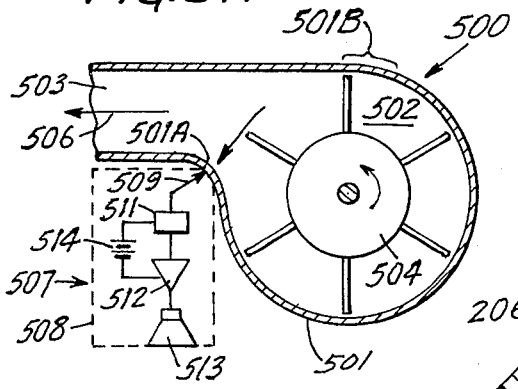
FIG. 3A is a diagrammatic view partly sectioned of a second modification of the particle flow monitoring apparatus of the invention.

Referring to FIG. 3A, there is shown an impeller assembly or blower indicated generally at 500. Assembly 500 has a wall 501 defining a chamber 502. Located within chamber 502 is an impeller or rotor having vanes or blades operable to move fluid and particles through chamber 502 and out exit opening 503, as shown by arrow 506. In operation, centrigugal forces on the particles cause the particles to move outwardly and strike or hit the housing wall 501 thereby producing mechanical signals.

A particle sensing means, indicated generally at 507, is operative to sense the mechanical signals and convert these signals into output information related to the flow of particles through chamber 502. Sensing means 507 has a housing or box 508 attached to housing wall 501. Located within box 508 is a needle or stylus 509 having an end in engagement with a portion of the housing wall portion 501A. Box 508 can be located in other locations relative to the wall 501, for example, wall portion 501B.

Stylus 509 is attached to a member 511, as a piezoelectric element, piezoelectric ceramic, or moving coil element, operable to transform mechanical movements of the stylus into electrical signals. The electrical signals are fed to an amplifier 512 and an output component 513, as a speaker, operable to produce readable information. The electrical circuit for sensing means 507 has a power source 514 as well as other components required to produce a readable output signal. Stylus 509 can engage a vibration isolated member, as a disk, mounted in an opening in housing wall 501. A sensing means having a piezoelectric material, as shown in FIG. 3, can be used in lieu of sensing means 507.

Figure 10:
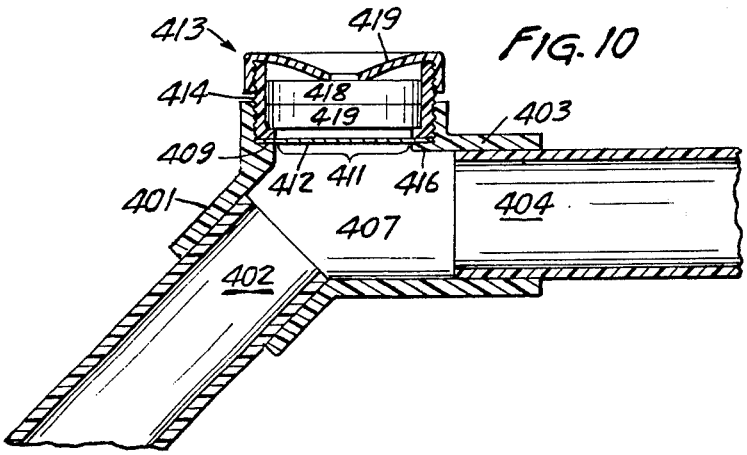
FIG. 10 is a longitudinal sectional view of a fourth modification of the particle monitoring apparatus of the invention.

Sensing means 507 can be used with a particle flow monitor having a sheet member such as member 412 shown in FIG. 10. The stylus can engage member 412 to sense mechanical signals imparted thereto by particles hitting the member.

Figure 4:
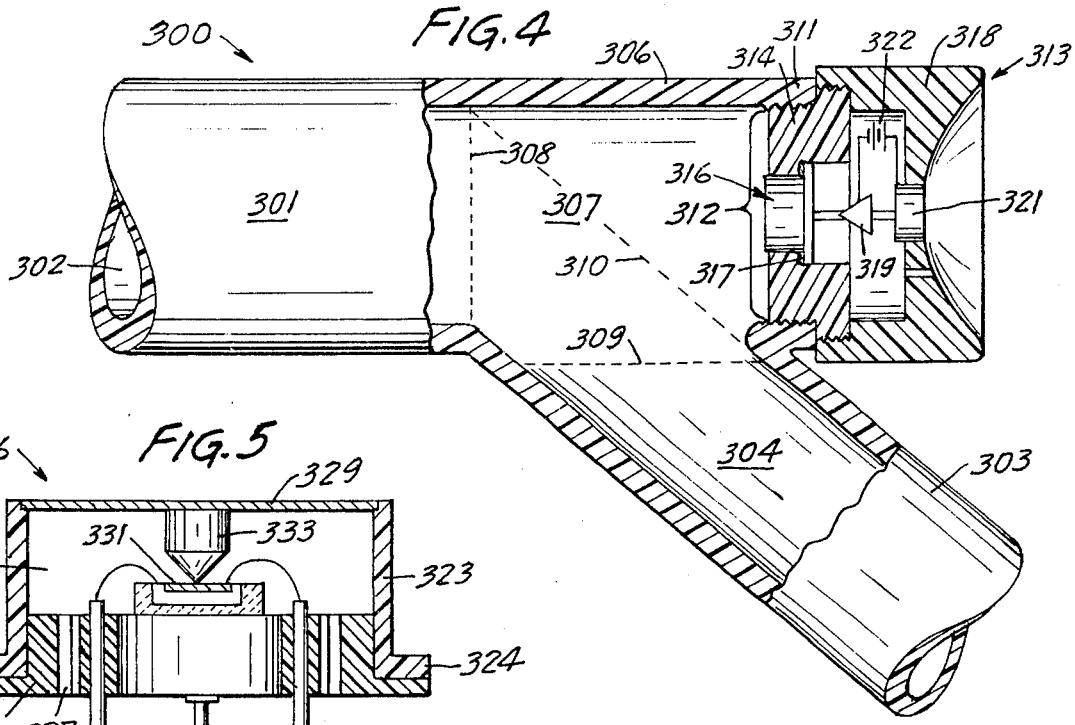
FIG. 4 is a longitudinal side view partly sectioned of a third modification of the particle flow monitoring apparatus of the invention.
Figure 5:
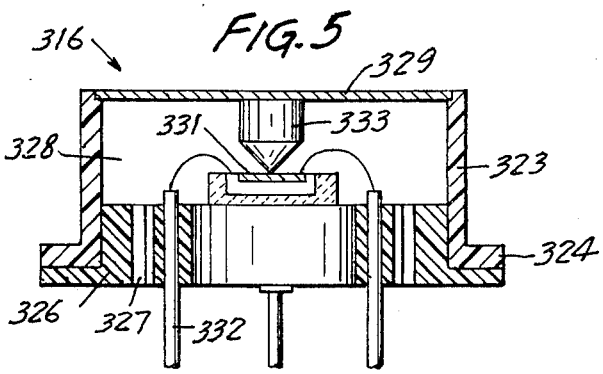
FIG. 5 is an enlarged sectional view of the sensor of FIG. 4.

Referring to FIGS. 4 and 5, there is shown another modification of the particle monitoring apparatus, indicated generally at 300 for sensing particles entrained in a moving fluid, as air. Apparatus 300 has an inlet tube 301 having a first or inlet passage 302 for carrying the fluid and particles. Angularly disposed with respect to inlet tube 301 is a second or exit passage 304. Tubes 301 and 302 are joined with connecting structure 306. The connecting structure 306 surrounds a chamber 307 having an inlet opening 308 in communication with inlet passage 302 and an outlet opening 309 in communication with exit passage 304 so that the air and particles are free to flow through the device.

Connecting structure 306 has an annular flange 311 defining an opening 312 opposite opening 308. A sensing unit, indicated generally at 313, is attached to flange 311. The unit functions to detect movement of particles through chamber 307 and provide a readable output signal related to the second particles. Opening 312 may be along the longitudinal plane of exit pipe 303, as shown by broken line 310.

Sensing unit 313 has a plug or body 314 that is threaded into the flange 311. Body 314 has a stepped central hole accommodating a sensor component 316. A flexible adhesive 317, as epoxy, secures the sensor component to body 314. A snap ring or threaded ring can be used to hold the sensor component to the body. A cap 318 is attached to body 314. Located within cap 318 is an amplifier 319 connected to a circuit 321 having an output component, as a speaker, and a power source 322 as a battery. Circuit 321 has other components which are required to produce readable output signals. Sensor component 316 uses mechanical force to produce a stress on a transistor to cause changes in transistor current gain. The change in the current gain, when, fed to the amplifier and circuit, produces an audio or visual output related to the amount of stress applied to the transistor. The mechanical force is caused by impaction of particles on part of the sensor component 316.

Referring to FIG. 5, sensor component 316 has a housing or can 323 having an outwardly directed flange 324 used to support the sensor component on the body 314. The flange end of the housing carries a header 326 having a plurality of ports or holes 317 providing a passageway to the interior chamber 328 to equalize the fluid pressures on opposite sides of a diaphragm 329 closing chamber 328. Located in chamber 328 and secured to header 326 is a NPN planar transistor 331. Conductors 332 are connected to the transistor 331. Located in chamber 328 and secured to the mid-portion of diaphragm 329 is a stylus 333. Stylus 333 has a pointed end in contact with transistor 321. The impaction of particles on diaphragm 329 provides a mechanical force which is applied through stylus 333 to transistor 321. This localized stress on the upper transistor surface causes a large reversible change in the current across the NPN junction. The differential pressure or point force applied to the diaphragm 329 produces a large reversible change in the gain of the transistor. This change in the electrical characteristics is utilized by means of the amplifier 319 and suitable circuits to produce a readable output which is a function of the particles that strike the diaphragm 329. An example of the sensor component is a Pitran silicone NPN planar transistor available from Stow Laboratories, Inc., Hudson, Massachusetts.

Figure 6:
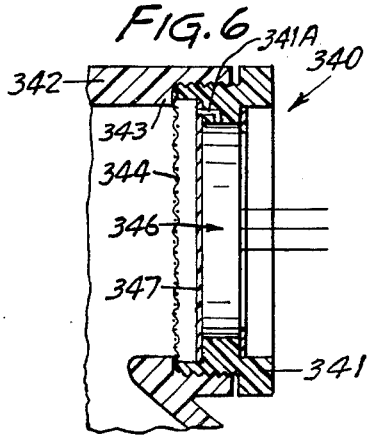
FIG. 6 is a sectional view of a modified sensor usable in the apparatus of FIG. 4.

Referring to FIG. 6, there is shown a modified particle sensing apparatus, indicated generally at 340, usable in a particle monitoring device of the invention. The sensing apparatus 340 has a body 341 that is attached to a connecting structure 342 similar to connecting structure 306 shown in FIG. 4. Connecting structure 342 has an inwardly directed annular lip 343 carrying an open barrier 344, as a mesh screen, providing a mechanical barrier for large particles. The body 341 clamps the outer peripheral edge of the barrier 344 onto lip 343. Mounted in the body 341 is a sensor component 346 having a large particle sensing diaphragm 347. Sensor component 346 is the same type of unit as the sensor component 316 shown in FIG. 5. Body 341 has a passage 341A providing fluid communication between the inside of component 346 and the environment outside of diaphragm 347 to balance the fluid pressures on the diaphragm 357. The diaphragm 347 of the sensor component is larger than the diaphragm 329 of sensor 316. The open barrier 344 may be removed, whereby diaphragm 347 will receive the full impact of all particles directed thereto. This will increase the sensitivity of the component 346. The sensor component 346 is connectable to an amplifier and output circuit structure as shown in FIG. 4.

Figure 7:
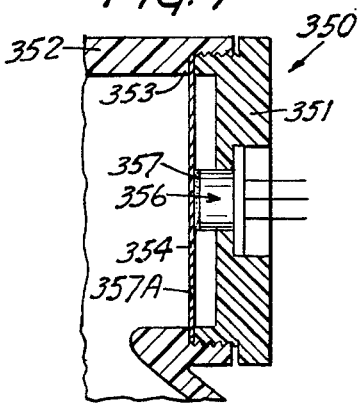
FIG. 7 is a sectional view of another modification of sensor usable with the apparatus of FIG. 4.

Referring to FIG. 7, there is shown a further modification of the particle sensing apparatus, indicated generally at 350. Unit 350 has a body 351 mounted on connecting structure 352. Connecting structure 352 has an inwardly directed annular lip 353 carrying a flexible sheet member 354. The outer peripheral edge of the sheet member is clamped into engagement with lip 352 by body 351. Located in a central stepped passage in body 351 is a sensor component 356 similar to component 316 shown in FIG. 5. The component 356 has an active surface or diaphragm 357 attached with a suitable bonding material to the center portion of sheet member 354. Diaphragm 357 has a hole 357A. The particles which strike sheet member 354 produce a mechanical force which is transmitted to the active surface or diaphragm of the sensor component. This force is transmitted to the NPN juncture or transistor through a stylus, thereby changing the electrical characteristics of the transistor.

Figure 8:
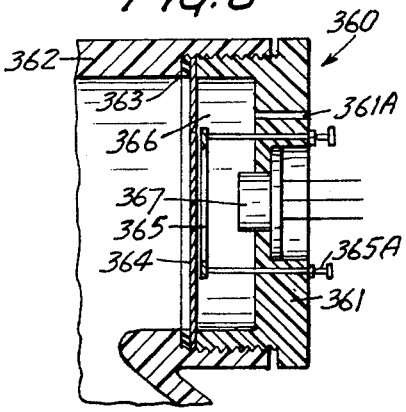
FIG. 8 is a sectional view of another modification of sensor usable with the apparatus of FIG. 4.

Referring to FIG. 8, there is shown a further modification of the particle sensing unit, indicated generally at 360. Unit 360 has a body 361 having hole 361A attached to connecting structure 362. Connecting structure 362 has an inwardly directed lip 363 having a shoulder for accommodating an outer peripheral edge of a flexible sheet member 364. Body 361 is threaded into connecting structure 362 to clamp the sheet member 364 to the lip 363. The sheet member 364 encloses a chamber 366 within body 361. The center portion of body 361 has a stepped hole accommodating sensor component 367. Component 367 is identical with the component 316 shown in FIG. 5. Chamber 366 is filled with air via hole 361A, which transmits sound energy or mechanical vibrations from the sheet member 364 to the active surface or diaphragm of the sensor component 367. Hole 361A allows restricted or minimal venting of air from chamber 366 to balance the pressures on opposite sides of sensor diaphragm of component 367. The particles which hit sheet member 364 produce a mechanical vibration or signal that is transmitted and modulated via the fluid in chamber 366 to the sensor component 367. This mechanical force acts on the stylus to change the electrical characteristics of the NPN transistor. The result is a readable output related to particle impaction on the sheet member 364. A stop barrier 365, showing as a ring, is located between diaphragm 364 and component 367 to prevent the diaphragm from over driving the component. Adjusting screws 365A threaded through body 361 support barrier 365 adjacent diaphragm 364.

Figure 9:
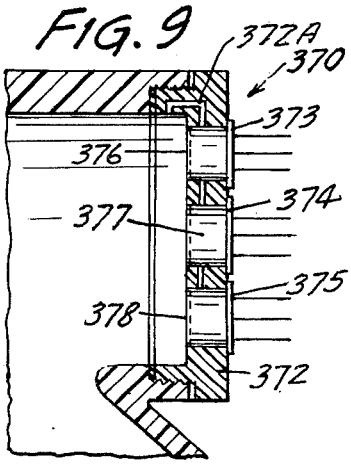
FIG. 9 is a sectional view of another modification of sensor usable with the apparatus of FIG. 4.

Referring to FIG. 9, there is shown yet another particle sensing unit, indicated at 370, having a body 372. Body 372 has a plurality of openings accommodating a plurality or array of sensor components 373, 374 and 375. Three sensor components are shown in FIG. 9. Any number of components can be used. Also, the components can be used indvidually and in groups. Passage 372A in body 372 balances the pressures on opposite sides of the diaphragms. Each sensor component has a diaphragm 376, 377 and 378. The internal structure of the sensor components 373, 374 and 375 follows sensor 316 shown in FIG. 5. Diaphragms 376, 377 and 378 can have different degrees of thickness and strength whereby the sensor components 373, 374 and 375 have different degrees of sensitivity to particles striking the diaphragms. The amount of particles as well as particle size distribution can be determined with the use of the different readings from the sensor components.

Referring to FIG. 10, there is shown a further form of the particle monitoring apparatus, indicated generally at 400, for detecting or measuring the mass flow of dispersed particles in a moving fluid. Particle monitoring device 400 has an inlet tube 401 having an inlet passage 402. An outlet tube 403 having an exit passage 404 is joined to the inlet tube with a connecting structure 406. Connecting structure 406 surrounds a chamber in communication with both the inlet passage and the exit passage whereby fluid and particles carried by the fluid can move unobstructed through the particle monitoring apparatus. The connecting structure has a generally annular outwardly directed flange 408 having an inwardly directed lip 409. The lip surrounds an opening 411 in communication with the chamber 407. The opening 411 is in general axial alignment with the inlet passage 402.

A particle sensing sheet member 412 extends across opening 411. The sheet member 412 has an outer peripheral edge resting on the lip 409. A sensing unit, indicated generally at 413, is secured to flange 408. Sensing unit 413 has a body 414 threaded into flange 408. The lower portion of body 414 engages the outer peripheral edge of sheet member 412, clamping the sheet member into engagement with lip 409. Body 414 has an inwardly directed shoulder 416 adjacent the sheet member 412. Supported on the shoulder 416 is a sound pickup device 417, as a microphone. The sound pickup device is operable to pick up, amplify and transmit the sound energy established by impaction of particles on the sheet member 412. Electrically coupled to the sound pickup device 417 is an output device 418 having an amplifier with suitable electrical circuits to provide readable information as to the impingement of particles on the sheet member 412. This information can be audio or visual and is directly related to the flow of particles through the monitoring device. A cap 419 is mounted on body 414 to enclose the output device and pickup device within body 414.

The drawings and description are directed to the preferred embodiments of the invention. Modifications and alterations in the size, number, shape, materials, sensors and electronic circuits and output reading devices may be made by one skilled in the art without departing from the spirit and scope of the invention.

The embodiments of the invention in which an exclusive property or privilege is claimed are defined as follows:

1. An apparatus for sensing materials moving with a flowing fluid comprising: housing means having a wall surrounding a chamber, an inlet passage means connected to the chamber and an outlet passage means connected to the chamber, said outlet passage means being angularly disposed with respect to the inlet passage means for carrying moving fluid and particles entrained in the fluid, said wall having an opening in longitudinal communication with the inlet passage, particle sensing means mounted on said housing means, said particle sensing means having first means located in said opening of the wall and closing said opening without projecting into said chamber, said first means including a member in general longitudinal alignment with the inlet passage means upon which substantially all of the particles moving through the chamber impinge and thereby produce a mechanical signal, barrier means located adjacent the first means to limit the size of particle that can impinge on the first means, second means cooperating with said first means to pick up the mechanical signal and transform said mechanical signal to an electrical signal, output means for receiving the electrical signal and producing readable information related to particle impaction on the first means.

2. The apparatus of claim 1 wherein: the first means is an impact plate and the second means is a piezoelectric ceramic bonded to the impact plate, said piezoelectric ceramic operable to generate an electrical signal related to the impaction of particles on the impact plate.

3. The apparatus of claim 1 including: means to resiliently mount the sensing means on said housing means.

4. An apparatus for sensing materials moving with a flowing fluid comprising: housing means having a wall surrounding a chamber, an inlet passage means connected to the chamber and an outlet passage means connected to the chamber, said outlet passage means being angularly disposed with respect to the inlet passage means for carrying moving fluid and particles entrained in the fluid, said wall having an opening in longitudinal communication with the inlet passage, particle sensing means mounted on said housing means, said particle sensing means having first means located in said opening of the wall and closing said opening without projecting into said chamber, said first means including a member in general longitudinal alignment with the inlet passage means upon which substantially all of the particles moving through the chamber impinge and thereby produce a mechanical signal, second means cooperating with said first means to pick up the mechanical signal and transform said mechanical signal to an electrical signal, said first means including a sheet member upon which particles impinge and said second means including a sensing unit for receiving mechanical force from said sheet member and transmit said mechanical force to a transistor to alter the electrical characteristics of the transistor, said alteration of the electrical characteristics of the transistor being related to the impingement of the particles on the sheet member, and output means for receiving the electrical signal and producing readable information related to particle impaction on the first means.

5. The apparatus of claim 4 wherein: the sheet member is attached to the sensor unit.

6. The apparatus of claim 4 wherein: the sheet member is spaced from the sensor unit.

7. An apparatus for sensing material moving with a flowing fluid comprising: housing means having a wall surrounding a chamber, an inlet passage means connected to the chamber and an outlet passage means connected to the chamber, said outlet passage means being angularly disposed with respect to the inlet passage means for carrying moving fluid and particles entrained in the moving fluid, said wall having an opening in longitudinal communication with the inlet passage, particle sensing means mounted on said housing means, said particle sensing means having first means located in said opening of the wall and closing said opening without projecting into said chamber, said first means including a member in general longitudinal alignment with the inlet passage means upon which substantially all the particles moving through the chamber impinge and thereby produce a mechanical signal, said particle sensing means including a plurality of sensing means, each sensing means having diaphragm means upon which particles impinge to produce mechanical signals, second means cooperating with said diaphragm means to pick up the mechanical signals and transform said mechanical signals to electrical signals, said second means including a transistor, said mechanical signals being transmitted to the transistor to change the electrical characteristics of the transistor, said change in the electrical characteristics of the transistor being related to the particles that impinge on said diaphragm means, and output means for receiving the electrical signals and producing readable information related to particle impaction on the diaphragm means.

8. An apparatus for sensing materials moving with a flowing fluid comprising: housing means having a wall surrounding a chamber, an inlet passage means connected to the chamber and an outlet passage means connected to the chamber, said outlet passage means being angularly disposed with respect to the inlet passage means for carrying moving fluid and particles entrained in the fluid, said wall having an opening in longitudinal communication with the inlet passage, particle sensing means mounted on said housing means, said particle sensing means having first means located in said opening of the wall and closing said opening without projecting into said chamber, said first means including a member in general longitudinal alignment with the inlet passage means upon which substantially all of the particles moving through the chamber impinge and thereby produce a mechanical signal, second means cooperating with said first means to pick up the mechanical signal and transform said mechanical signal to an electrical signal, said first means including a diaphragm upon which particles impinge and said second means including a stylus attached to the diaphragm and a transistor engaged by the stylus, said stylus transmitting mechanical forces to the transistor and thereby changing the electrical characteristics of the transistor, said changes in the electrical characteristic of the transistor being related to the impingement of particles on the diaphragm, and output means for receiving the electrical signal and producing readable information related to particle impaction on the first means.

9. An apparatus for sensing materials moving with a flowing fluid comprising: housing means having a wall surrounding a chamber, an inlet passage means connected to the chamber and an outlet passage means connected to the chamber, said outlet passage means being angularly disposed with respect to the inlet passage means for carrying moving fluid and particles entrained in the fluid, said wall having an opening in longitudinal communication with the inlet passage, particle sensing means mounted on said housing, said particle sensing means having first means located in said opening of the wall and closing said opening without projecting into said chamber, said first means including a member in general longitudinal alignment with the inlet passage means upon which substantially all the particles moving through the chamber impinge and thereby produce a mechanical signal and a plurality of sensing means, at least some if the sensing means being operable to sense different ranges of mechanical signals, second means cooperating with said first means to pick up the mechanical signals and transform said mechanical signals into electrical signals, and output means for receiving the electrical signals and producing readable information related to the particle impaction on the first means.

10. An apparatus for sensing particles in a flowing fluid comprising: means having a chamber through which fluid and particles can flow and an opening, particle sensing means comprising a particle sensing unit mounted on said means, said sensing unit having sensor means located in said opening at one side of the chamber for receiving impaction signals of particles which strike said sensor means and transform said impaction signals to electrical signals, and sensor means positioned relative to said chamber so as not to obstruct the flow of fluid and particles through said chamber, and electric circuit means for receiving said electrical signals to provide readable information as to the movement of particles in the fluid moving through said chamber, said sensor means including a diaphragm upon which particles impringe, a stylus attached to the diaphragm, and a transistor engaged by the stylus, said stylus transmitting mechanical forces to the transistor and thereby changing the electrical characteristic of the transistor, said changes in the electrical characteristic of the transistor being directly related to the impingement of particles on the diaphragm.

11. An apparatus for sensing particles in a flowing fluid comprising: means having a chamber through which fluid and particles can flow and an opening, particle sensing means comprising a particle sensing unit mounted on said means, said sensing unit having sensor means located in said opening at one side of the chamber for receiving impaction signals of particles which strike said sensor means and transform said impaction signals to electrical signals, said sensor means positioned relative to said chamber so as not to obstruct the flow of fluid and particles through said chamber, said sensor means including a sheet member upon which particles hit and means for receiving mechanical force from said sheet member and transmitting said mechanical force to a transistor to alter the electrical characteristics of the transistor, said alteration of the electrical characteristics of the transistor being related to the impingement of particles on the sheet member, and electric circuit means for receiving said electrical signals to provide readable information as to the movement of particles in the fluid moving through the chamber.

12. The apparatus of claim 11 wherein: the sheet member is attached to the sensor unit.

13. The apparatus of claim 11 wherein: the sheet member is spaced from the sensor unit.

14. An apparatus for sensing particles in a flowing fluid comprising: means having a chamber through which fluid and particles can flow and an opening, particle sensing means comprising a plurality of sensing units mounted on said means, said sensing units having sensor means located in said opening at one side of the chamber for receiving impaction signals of particles which strike said sensor means and transform said impaction signals to electrical signals, at least some of the sensing units being operable to sense different ranges of mechanical signals, said sensor means being located in said opening at one side of the chamber for receiving impaction signals which strike said sensor means and transform said impaction signals to electrical signals, said sensor means positioned relative to said chamber so as not to obstruct the flow of fluid and particles through said chamber, and electric circuit means for receiving said electrical signals to provide readable information as to the movement of particles in the fluid moving through said chamber.

15. An apparatus for sensing particles moving with a flowing fluid comprising: means having a wall surrounding a chamber, inlet passage means and an outlet passage means in communication with said chamber, said outlet passage means being angularly disposed with respect to the inlet passage means for carrying moving fluid and particles entrained in the fluid, said wall having an annular outwardly directed flange surrounding an opening, said opening being in general longitudinal alignment with the inlet passage means, particle sensing means operable to produce readable information related to particles flowing through said chamber, said particle sensing means having a housing, means including a resilient annular mount resiliently mounting the housing on said flange, disc means mounted on said housing closing said opening, said disc means being located in a position wherein it does not project into said chamber whereby substantially all of the particles moving through said chamber impinge on said disc means, open barrier means located adjacent the disc means to limit the size of particles that impinge on the disc means, second means engageable with said disc means to sense the mechanical signals caused by particles impinging on said disc means and transform said mechanical signals to electrical signals, output means for receiving the electrical signals and producing the readable information related to particle impaction on said disc means, said second means and output means being mounted on said housing.

16. The apparatus of claim 15 wherein: the second means is a piezoelectric member mounted on said disc means, said piezoelectric member operable to generate an electrical signal related to the impaction of particles on said disc means.

17. The apparatus of claim 15 wherein: the second means includes means cooperating with the disc means to sense mechanical signals of the disc means caused by particles impinging on said disc means and transform said mechanical signals to electrical signals, and said output means including electric circuit means for sensing the electric signals and producing readable information related to the impingement of particles on said disc means.

* * * * *

UNITED STATES PATENT AND TRADEMARK OFFICE

CERTIFICATE OF CORRECTION

PATENT NO. : 3,989,311

DATED : November 2, 1976

INVENTOR(S) : Robert J. De brey

It is certified that error appears in the above–identified patent and that said Letters Patent are hereby corrected as shown below:

Column 2, line 21, after "expansion", --chamber-- is omitted.

Column 5, line 12, "second" should be --sensed--.

Column 5, line 38, "317" should be --327--.

Column 6, line 64, "showing" should be --shown--.

Column 7, line 22, after "flow", --rate-- is omitted.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*